US006180327B1

(12) United States Patent
McGuckin et al.

(10) Patent No.: US 6,180,327 B1
(45) Date of Patent: Jan. 30, 2001

(54) PHOTOGRAPHIC CONDITIONING SOLUTION CONTAINING POLYAMINOCARBOXYLIC ACID AS SOLE ANTIMICROBIAL AGENT AND METHOD OF USE

(75) Inventors: Hugh Gerald McGuckin; John Stuart Badger; Mary Ellen Craver, all of Rochester, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 08/417,290

(22) Filed: Apr. 5, 1995

(51) Int. Cl.[7] ..... G03C 11/00; G03C 5/18; G03C 5/26; G03C 7/46

(52) U.S. Cl. ..... 430/463; 430/372; 430/379; 430/407; 430/427; 430/428; 430/429; 430/432

(58) Field of Search ..... 430/372, 379, 430/407, 427, 428, 429, 432, 463

(56) References Cited

U.S. PATENT DOCUMENTS

| | | | | |
|---|---|---|---|---|
| 4,786,583 | | 11/1988 | Schwartz | 430/372 |
| 4,839,273 | * | 6/1989 | Yamada et al. | 430/450 |
| 4,921,779 | | 5/1990 | Cullinan et al. | 430/379 |
| 4,960,682 | | 10/1990 | Cullinan et al. | 430/393 |
| 4,975,356 | | 12/1990 | Cullinan et al. | 430/393 |
| 5,034,308 | | 7/1991 | Abe et al. | 430/372 |
| 5,037,725 | | 8/1991 | Cullinan et al. | 430/372 |
| 5,055,381 | * | 10/1991 | Abe et al. | 430/463 |
| 5,077,179 | * | 12/1991 | Abe et al. | 430/463 |
| 5,334,493 | * | 8/1994 | Fujita et al. | 430/428 |
| 5,348,845 | | 9/1994 | Morigaki et al. | 430/372 |
| 5,534,396 | * | 7/1996 | McGuckin et al. | 430/463 |
| 5,736,302 | * | 4/1998 | Buongiorne et al. | 430/379 |
| 5,811,225 | * | 9/1998 | McGuckin et al. | 430/379 |
| 5,866,633 | * | 2/1999 | Batts et al. | 430/463 |
| 6,074,805 | * | 6/2000 | Badger et al. | 430/379 |

FOREIGN PATENT DOCUMENTS

| | | | | |
|---|---|---|---|---|
| 0577 041 A2 | | 6/1992 | (EP) . | |
| 0 591 934 A1 | | 10/1992 | (EP) . | |
| 62-19850 | * | 1/1987 | (JP) | 430/463 |
| 6-110168 | * | 4/1994 | (JP) | 430/490 |
| 6-123954 | * | 5/1994 | (JP) | 430/490 |

OTHER PUBLICATIONS

Russell et al, *Principles & Practice of Disinfection, Preservation & Sterilization*, 1st Ed., 1982, p. 67.
Block, *Disinfection, Sterilization & Perservation*, 4th Ed., 1991, p. 39.

* cited by examiner

*Primary Examiner*—Mark L. Bell
*Assistant Examiner*—J. Pasterczyk
(74) *Attorney, Agent, or Firm*—J. Lanny Tucker

(57) ABSTRACT

A conditioning solution or bleach accelerating solution can be used to process color photographic films, especially color reversal films, to minimize magenta dye fade. This solution contains an antimicrobial composition that consists essentially of a polyaminocarboxylic acid or salt thereof as the sole antimicrobial agent. This agent is present in an amount of less than about 3 g/l.

20 Claims, No Drawings

PHOTOGRAPHIC CONDITIONING SOLUTION CONTAINING POLYAMINOCARBOXYLIC ACID AS SOLE ANTIMICROBIAL AGENT AND METHOD OF USE

FIELD OF THE INVENTION

This invention relates in general to color photography and in particular to methods and compositions useful in the processing of color photographic materials, especially color reversal photographic elements. More particularly, this invention relates to an improved pre-bleach stabilizing solution, and its use in the processing of the noted materials.

BACKGROUND OF THE INVENTION

Multicolor, multilayer photographic elements are well known in the art. Such materials generally have three different selectively sensitized silver halide emulsion layers coated on one side of a single support. Each layer has components useful for forming a particular color in an image. Typically, they utilize color forming couplers that form yellow, magenta and cyan dyes in the sensitized layers during processing.

After color development, it is necessary to remove the silver image that is formed coincident with the dye image. This can be done by oxidizing the silver using a suitable oxidizing agent, commonly referred to as a bleaching agent, in the presence of a halide, followed by dissolving the silver halide so formed using what is known as a fixing agent. In some instances, the bleaching and fixing steps are combined into a single bleach-fixing step.

One commercially important process intended for use with color reversal photographic elements that contain color couplers in the emulsion layers, or layers contiguous thereto, uses the following sequence of processing steps: first developing, washing, reversal bath, color developing, bleaching, fixing, washing and stabilizing. Another useful process has the same steps, but stabilizing is carried out between color developing and bleaching.

In such photographic processes, a bleach-accelerator bath is often used between the color developing and bleaching steps. The bleach-accelerator bath is also known as a "conditioning" bath or solution. It is used to "condition" the metallic silver developed in the two developing steps, for complete oxidation to silver halide and to help preserve the acidity of the bleaching solution by reducing carryover of color developer into the bleaching solution. The conditioning solution contains, as an essential component, an effective amount of a bleach accelerating agent. This agent is imbibed into the emulsion layers of the photographic element during treatment with the conditioning bath, and is accordingly present to exert its intended effect when the element is put into the bleaching solution.

Magenta dye instability is a particularly undesirable problem in color photography, as the magenta dye image may fade more rapidly than either the cyan or yellow dye images. This is particularly evident when arylpyrazolone type magenta dye forming color couplers are used. Thus, considerable effort has been exerted to find solutions to this problem, including the use of dye stabilizers in stabilization baths at the end of the processing method, as described in U.S. Pat. No. 4,786,583 (Schwartz).

It is also known from U.S. Pat. No. 4,921,779 (Cullinan et al), U.S. Pat. No. 4,975,356 (Cullinan et al) and U.S. Pat. No. 5,037,725 (Cullinan et al) that formaldehyde precursors can be incorporated into conditioning solutions to further improve magenta dye stability. These patents describe a number of formaldehyde precursors for this purpose including sodium formaldehyde bisulfite, hexamethylenetetramine and various methylol compounds.

Copending and commonly assigned U.S. Ser. No. 08/393,293 , filed Feb. 23, 1995, by Darmon et al and entitled "Photographic Conditioning Solution Containing Bleach Accelerator, Formaldehyde Precursor and Secondary Amine and Method of Use", describes the use of a secondary amine in conditioning solutions to enable the amount of formaldehyde precursor to be reduced without compromising the effect of the solution to stabilize magenta dyes in color reversal materials.

There is a need to prevent biogrowth (bacteria, yeast and fungi) in the conditioning solution. When the various components of known conditioning solutions are adjusted to change effects or the pH is changed, the concern about biogrowth increases because conventional solutions tend to be free of biogrowth. Excessive biogrowth may have an undesirable odor, or leave a residue on processed film that affects the image. Thus, there is a need for an effective means for preventing such biogrowth at an acceptable cost and without sacrificing other desirable properties such as biodegradability and stabilization of the magenta coupler in the processed elements.

SUMMARY OF THE INVENTION

The problems noted above have been overcome using a conditioning solution having a pH of from about 4.5 to about 8, and comprising a bleach accelerating agent, a formaldehyde precursor, and an antimicrobial composition consisting essentially of a polyaminocarboxylic acid or salt thereof as the sole antimicrobial agent, the antimicrobial agent being present in the conditioning solution in an amount of less than about 3 g/l.

This invention also provides a method for processing a color reversal photographic element comprising:

A) treating an imagewise exposed and developed color reversal photographic element with the conditioning solution as described above, and B) bleaching the treated element.

The present invention effectively provides a conditioning solution for the processing of color reversal materials that both stabilizes the magenta dye and provides bleach acceleration. In addition, this solution is suitably protected against biogrowth using a very small amount (≦3 g/l) of a polyaminocarboxylic acid (or salt thereof) as the sole antimicrobial agent. The antimicrobial agent is relatively inexpensive and because a limited amount is used, the conditioning solution is more suitable for the environment.

DETAILED DESCRIPTION OF THE INVENTION

A wide variety of color reversal photographic elements can be used in the practice of the present invention. A detailed description of such materials is found, for example, in *Research Disclosure,* publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below.

Color reversal photographic elements utilized in the practice of this invention are comprised of a support having on one side thereof a plurality of photosensitive silver halide emulsion layers. The photosensitive layers can contain any of the conventional silver halides as the photosensitive material, for example, silver chloride, silver bromide, silver bromoiodide, silver chlorobromide, silver chloroiodide, silver chlorobromoiodide, and mixtures thereof. Useful support materials include cellulose acetate film, polyvinylacetal film, polycarbonate film, polystyrene film, polyethylene terephthalate film, and the like. The silver halide is dispersed within a suitable hydrophilic colloid such as gelatin or derivatives thereof. The silver halide emulsion layers can contain a variety of well-known addenda, including but not limited to, chemical sensitizers, development modifiers and antifoggants.

As explained above, a well-known color reversal process of the prior art utilizes a first developer, a reversal bath, a color developer, a conditioning solution, a bleach bath, a fixing bath and a stabilizer bath. The components that are useful in each of such baths are well known in the photographic art. The improved process of this invention can utilize the same baths except that the stabilizer bath is not needed, that is, the final bath can be a rinse or wash bath consisting of water, or preferably an aqueous solution containing a sufficient amount of a surfactant to prevent spotting of the photographic film. In the present invention, the conditioning solution can be supplied as a concentrate that is diluted, and then used in a separate conditioning step, and is not used in conventional bleaching, fixing or bleach/fixing steps. Thus, the conditioning solution does not contain compounds for the conventional purpose of bleaching or fixing.

The first developer generally contains a black-and-white developing agent or a mixture thereof. Useful developing agents include, but are not limited to, dihydroxybenzene developing agents (such as hydroquinone), 3-pyrazolidone developing agents (such as 1-phenyl-3-pyrazolidone), and aminophenol developing agents (such as paraaminophenol). In addition to the developing agent, the first developer typically contains other agents such as preservatives, sequestering agents, restrainers, antifoggants, buffers and silver halide solvents.

The reversal bath generally contains a nucleating agent, such as a boron compound or a chelated stannous salt that functions as a reducing agent, as well as antioxidants, buffers, fungicides and sequestering agents.

In addition to an aromatic primary amino color developing agent, the color developing bath typically contains sequestering agents, buffering agents, preservatives, competing couplers and silver halide solvents.

Particularly useful aromatic primary amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include but are not limited to: N,N-diethyl-p-phenylenediamine monohydrochloride, 4-N,N-diethyl-2-methylphenylenediamine monohydrochloride, 4-(N-ethyl-N-2-methane-sulfonylaminoethyl)-2-methylphenylenediamine sesquisulfate monohydrate, 4-(N-ethyl-N-2-hydroxyethyl)-2-methyl-phenylenediamine sulfate, 4-N,N-diethyl-2,2'-methanesulfonylaminoethyl-phenylenediamine hydrochloride, and others readily apparent to a skilled worker in the art.

The essential component of the bleaching bath is a bleaching agent that converts metallic silver to silver ions. Other common components of the bleaching bath include halides, sequestering agents and corrosion inhibitors. Ammonium or alkali metal salts of a ferric complex of an aminopolycarboxylic acid are particularly useful as bleaching agents but other metal complexes are known in the art, including binary and ternary complexes. Also of particular utility are the persulfate bleaching agents such as ammonium or alkali metal persulfates and peroxide bleaching agents. Bleaching agents can be used individually or in the form of mixtures of two or more bleaching agents.

The fixing bath converts all silver halide into soluble silver complexes that diffuse out of the emulsion layers. Fixing bath retained within the layers of the photographic element is removed in a subsequent water washing step. Thiosulfates, including ammonium thiosulfate and alkali metal thiosulfates (such as sodium thiosulfate and potassium thiosulfate), are particularly useful as fixing agents. Other components of the fixing bath include preservatives and sequestering agents.

A wide variety of different color reversal processes are well known in the art. For example, a single color developing step can be used when the coupling agents are incorporated in the photographic element or three separate color developing steps can be used in which coupling agents are included in the developing solutions. The reversal step can be carried out by use of a reversal bath, by a re-exposure step, or by incorporating a fogging agent in the color developing bath. In order to provide shorter processing times, bleaching and fixing can be combined in a single step (known as a bleach-fixing step).

The present invention is particularly concerned with enhancing dye stability through the use of a bleach-accelerating (or conditioning) solution that contains a bleach accelerating agent, a formaldehyde precursor, and other components conventionally included in such solutions, such as sulfites and metal ion chelating agents.

The conditioning solution of this invention is an aqueous acidic solution typically having a pH in the range of from about 4.5 to about 8. Preferably, the pH is from about 4.5 to about 6.5. The pH can be adjusted and maintained using one or more acids or buffers, as would be readily apparent to one skilled in the art.

The solution also contains one or more bleach accelerating agents that are generally present in an amount (total amount) of less than or equal to about 20 g/l of working solution and more preferably in an amount of from about 0.1 to about 2 g/l. More preferably, the amount is from about 0.5 to about 1 g/l.

Sulfur-containing organic compounds are most commonly used as bleach accelerating agents in conditioning solutions in photographic processing. However, other types of compounds are also known, including polyalkylene oxides, organic amines, onium compounds, and n-hexoxyethanol. More details of these and the commonly used sulfur-containing compounds are provided in U.S. Pat. No. 4,921,779 (noted above) which patent is incorporated herein by reference, and references cited therein. A mixture of bleach accelerating agents can be used if desired.

Preferred bleach accelerating agents include but are not limited to, heterocyclic thiols such as aminothiadiazolethiol, mercaptotriazole, imidazolethiol and aminomercaptotriazole, disulfides [such as bis(2-aminoethane)disulfide, thioglycerol disulfide and bis(N,N-dimethyl-2-aminoethane)-disulfide] and thioethers (such as dithiaoctanediol and thiadiethanol). Especially preferred are aliphatic thiols of the formula I:

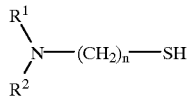

wherein each of $R^1$ and $R^2$ is H, methyl or ethyl and n is an integer having a value of from 1 to 3. Specific examples of such aliphatic thiols include 2-aminoethanethiol, 3-aminopropanethiol, dimethylaminoethanethiol, N-methyl-N-ethyl-aminoethanethiol and diethylaminoethanethiol.

The most preferred bleach accelerating agent for the purpose of this invention is monothioglycerol.

Also included in the conditioning solution concentrate of this invention are one or more formaldehyde precursors.

By the term "formaldehyde percursor" is meant any compound capable of establishing, in the conditioning solution, an equilibrium relationship between it and formaldehyde. While not being certain of the mechanism, it is believed that the precursor acts, in effect, as a formaldehyde donor that gradually releases formaldehyde into the solution at the same rate as it is used up in the dye-stabilizing reaction to thereby maintain the equilibrium relationship. Thus, the concentration of formaldehyde in the conditioning solution is always at a very low level and there is not enough formaldehyde in the solution to result in a buildup or undesirably high concentrations in the air above the solution.

Formaldehyde precursors that are useful for the purpose of this invention include but are not limited to the water-soluble N-methylol compounds. As used herein, the term "N-methylol compound" refers to a compound having at least one methylol group attached directly to a nitrogen atom. Particularly useful are N-methylol compounds represented by formulae I, II or III in U.S. Pat. No. 4,921,779 (noted above).

Illustrative N-methylol compounds include: dimethylol urea, trimethylol urea, dimethylol guanidine, trimethylol melamine, tetramethylol melamine, pentamethylol melamine, and hexamethylol melamine.

Another particularly preferred N-methylol compound is 1,3-dimethylol-5,5-dimethyl hydantoin.

In addition to the N-methylol compounds, examples of especially effective formaldehyde precursors include sodium formaldehyde bisulfite and hexamethylenetetraamine.

The formaldehyde precursor can be added to the concentrate as a specifically added component, or it can be formed in situ by the reaction of formaldehyde and a bisulfite as one skilled in the art would readily understand.

The formaldehyde precursor is present in the conditioning solution in an amount of less than or equal to about 45 g/l of concentrate, with an amount of from about 20 to about 30 g/l being preferred, and from about 22.5 to about 25 g/l being more preferred.

An optional (but preferred) material in the conditioning solution of this invention is a sulfite preservative (or a plurality thereof). It is present in an amount of from 0 to about 10 g/l of concentrate. Preferably, the sulfite is present in an amount of from 0 to about 8 g/l, and more preferably it is present at from about 4 to about 6.5 g/l.

Useful sulfites (and corresponding bisulfites) are well known in the art and include, for example, sodium sulfite, potassium sulfite, lithium sulfite, ammonium sulfite and corresponding bisulfites. Potassium and sodium sulfites are preferred.

Also optionally included in the solution is one or more metal ion chelating agents, such as chelating agents for iron, calcium, magnesium, manganese, copper and other metals commonly found in processing solutions. Preferably, chelating agents for iron ions (such as ferric ion) are used. Useful chelating agents are well known in the art such as polydentate carboxylic acids and phosphonic acids that are generally known for photographic bleaching solutions.

An optional component of the conditioning solution of this invention is a secondary amine compound such as those described in the Darmon et al application, U.S. Ser. No. 08/393,293, identified above. Such compounds have at least one secondary amine moiety, and may have up to 3 of such groups in the molecule. The secondary amines can be linear or cyclic, as described in the noted application. Preferably, the secondary amines are either dialcoholamines or 6-membered heterocyclic rings having at least one secondary amine moiety in the ring. Representative secondary amines include, but are not limited to, diethanolamine, diisopropanolamine, N-methyl-N-ethylamine, N-hydroxyethyl-N-benzylamine, N-methyl-N-phenylamine, N,N-bis(hydroxyethyl)amine, pyrrolidine, imidazole, 1,4-dihydropyridine, 3-pyrroline, morpholine, piperidine and piperazine. Of these, diethanolamine, morpholine and piperidine are most preferred.

The amount of secondary amine useful in the solution is generally at least about 0.075 g/l, with from about 0.15 to about 2 g/l being preferred.

The conditioning solution of this invention can also include various addenda commonly included in such solutions, as described in the art cited above, including, but not limited to, anti-scumming agents, surfactants, buffers and antioxidants.

It is particularly useful in the practice of this invention that the conditioning solution contains an antimicrobial composition that consists essentially of a single type of antimicrobial agent. This agent is designed to prevent any appreciable biogrowth (that is, both gram-positive and gram-negative bacterial and fungal growth) in the conditioning solution during storage or use.

Useful antimicrobial agents are believed to be magnesium or calcium ion chelators, and can be more specifically defined as polyaminocarboxylic acids or salts thereof. A mixture of such materials can be used if desired but only this type of compound is used as the antimicrobial agent in the conditioning solution. In other words, the one or more polyaminocarboxylic acids are used as the sole antimicrobial agent(s). They are not used in combination with other materials known to have biocidal or antimicrobial activity. The term "antimicrobial" refers to the compound's ability to inhibit or prevent both bacterial and fungal growth.

The one or more antimicrobial agents are present in the conditioning solution at about 3 or less g/l. Generally, the antimicrobial agent is present in an amount of from about 0.25 to about 3 g/l, preferably, it is present at from about 0.25 to about 2.5 g/l, and more preferably at from about 0.5 to about 1.5 g/l.

There are many polyaminocarboxylic acids and salts that could be considered for this use. These compounds are generally polydentate, that is having two or more, and preferably at least four, carboxylic acid (or salts) groups within the molecule.

A simple test can be carried out to determine if a given compound is useful as an antimicrobial agent in the practice of this invention:

To a typical conditioning solution that has been "seasoned" by adding 20 ml of conventional, seasoned Process E-6 Color Developer per 80 ml (unseasoned solution), an inoculum containing various gram-positive (notably *Enterococcus casseliflavus*) and gram-negative bacteria (notably Pseudomonas species) and fungi (notably Aureobasidium species) is added to provide about $10^3$ CFU (colony forming units)/ml of solution. The seasoned conditioning solution also contains (per liter): sodium formaldehyde bisulfite (15 g), thioglycerol (0.4 ml), potassium sulfite (45 weight %, 10 ml), succinic acid buffer (4 g), diethanolamine (85 weight %, 0.1 ml), potassium hydroxide (45%, 1 ml), and the proposed antimicrobial agent (up to 3 g). The solution has a final pH of about 7.

The resulting mixture is then incubated at 300° C. for 72 hours, after which the level of biogrowth is measured. If the level of biogrowth is less than or equal to $10^3$ CFU/ml (that is, the original amount), the proposed antimicrobial agent has suitable antimicrobial activity to be within the scope of the present invention. If the level of biogrowth increases above $10^3$ CFU/ml by a statistically significant amount, the compound has insufficient antimicrobial activity and is not within the scope of this invention.

Compounds that did not consistently pass the noted test for several replicates included diethylenetriaminepentaacetic acid, aminotris(methylphosphonic acid), pentasodium salt and 2-hydroxy-1,2,3-propanetriacarboxylic acid. In such cases, it was observed that the biogrowth increased to at least $10^5$ CFU/ml unless the amount of the compound was more than 3 g/l, in which case, that compound is not useful in the practice of this invention.

Some preferred polyaminocarboxylic acid antimicrobial agents can be represented by either of the following formulae:

II

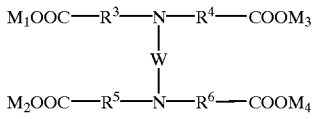

III

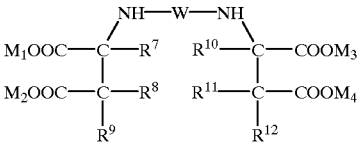

wherein $R^3$, $R^4$, $R^5$ and $R^6$ are independently a linear or branched, substituted or unsubstituted alkylene group of 1 to 8 carbon atoms (such as methylene, ethylene, trimethylene, hexamethylene, 2-methyltrimethylene and 4-ethylhexamethylene). $R^7$, $R^8$, $R^9$, $R^{10}$, $R^{11}$ and $R^{12}$ are independently hydrogen, hydroxy, a linear or branched, substituted or unsubstituted alkyl group of 1 to 5 carbon atoms (such as methyl, ethyl, isopropyl, t-butyl, n-pentyl, and 2-ethylpropyl), a substituted or unsubstituted cycloalkyl group of 5 to 10 carbon atoms in the ring (such as cyclopentyl, cyclohexyl, cycloheptyl and 2,6-dimethylcyclohexyl), or a substituted or unsubstituted aryl group having 6 to 10 carbon atoms in the aromatic nucleus (such as phenyl, naphthyl, tolyl and xylyl).

In formulas II and III, W is a covalent bond or a divalent substituted or unsubstituted aliphatic linking group. Such a group includes any nonaromatic linking group comprised of one or more alkylene, cycloalkylene, oxy, thio, amino or carbonyl groups that form a chain of 1 to 6 atoms. Examples of such groups include, but are not limited to, alkylene, alkyleneoxyalkylene, alkylenecycloalkylene, alkylenethioalkylene, alkyleneaminoalkylene, alkylenecarbonyloxyalkylene, all of which can be substituted or unsubstituted, linear or branched, and others that would be readily apparent to one skilled in the art.

In defining the groups for formulae II and III above, the term "substituted" means the presence of one or more substituents on the group, such as an alkyl group of 1 to 5 carbon atoms (linear or branched), hydroxy, sulfo, carbonamido, sulfonamido, sulfamoyl, sulfonato, thioalkyl, alkylcarbonamido, alkylcarbamoyl, alkylsulfonamido, alkylsulfamoyl, carboxy, amino, halo (such as chloro or bromo), sulfono ($—SO_2R'$) or sulfoxo[$—S(=O)R'$] wherein R' is a branched or linear alkyl group of 1 to 5 carbon atoms.

$M_1$, $M_2$, $M_3$ and $M_4$ are independently hydrogen or a monovalent cation (such as an alkali metal ion like sodium or potassium ion, ammonium, or other monovalent cations readily apparent to one skilled in the art).

In preferred embodiments, $R^3$, $R^4$, $R^5$ and $R^6$ are independently a substituted or unsubstituted alkylene group of 1 to 3 carbon atoms. More preferably, each is independently methylene or ethylene, and most preferably, each is methylene.

It is also preferred that $R^7$, $R^8$, $R^9$, $R^{10}$, $R^{11}$ and $R^{12}$ are independently hydrogen, hydroxy or methyl, and more preferably, each is hydrogen or methyl.

W is preferably a covalent bond or a substituted or unsubstituted alkylene group of 1 to 3 carbon atoms or a cycloalkylene of 5 to 7 carbon atoms. When W is cycloalkylene, the two nitrogen atoms are attached to the ring in an ortho position so there are only two carbon atoms between them. More preferably, W is methylene, ethylene or cyclohexylene with the nitrogen atoms attached to the ring in the ortho positions.

Preferably, each of $M_1$, $M_2$, $M_3$ and $M_4$ is hydrogen or an alkali metal ion such as sodium or potassium.

The compounds represented by formula II are more preferred. Representative antimicrobial agents of formula II include, but are not limited to, ethylenediaminetetraacetic acid and 1,2-cyclohexanediaminetetraacetic acid. The first compound is most preferred.

The antimicrobial agents useful in the practice of this invention are effective to maintain the total colony forming units (CFU/ml) in the solution at less than about 10 CFU/ml. The biogrowth typically controlled using this invention include, but are not limited to, bacteria such as Pseudomonas species (such as *Pseudomonas aeruginosa*) and *Enterococcus casseliflavies* and fungi such as Aureobasidium species.

The conditioning solution of this invention can be provided as a working strength solution, or as a concentrate that requires dilution of up to 20 times prior to or during use. Moreover, it can also be used as a replenishment solution.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure,* noted above. All types of emulsions can be used in the elements, including but not limited to, thin tabular grain emulsions, and either positive-working or negative-working emulsions.

The present invention is particularly useful for processing imagewise exposed and developed photographic elements containing arylpyrazolone type magenta dye forming color couplers. Such color couplers are well known in the art. One such compound is described in U.S. Pat. No. 5,037,725 (noted above).

The elements are typically exposed to suitable radiation to form a latent image and then processed as described above to form a visible dye image.

The conditioning solution of this invention is generally supplied to the processing equipment in a suitable manner and used to process the element prior to bleaching.

The conditioning step is generally carried out for less than 5 minutes, but longer times can be used if desired. Preferably, the conditioning time is from about 0.5 to about 3 minutes. The temperature at which the conditioning step is carried out is generally at or above room temperature, for example from about 20 to about 40° C.

Processing according to the present invention can be carried out using conventional deep tanks holding processing solutions. Alternatively, it can be carried out using what is known in the art as "low volume thin tank" processing systems having either rack and tank, automatic tray or similar designs. Such processing methods and equipment are described, for example, in recently allowed U.S. Ser. No. 08/221,711 (filed Mar. 31, 1994, by Carli et al), now U.S. Pat. No. 5,436,118, and publications noted therein.

As used herein to define amounts and times, "about" refers to ±10% of the indicated value. In reference to temperatures, "about" refers to ±5° C. In defining pH, "about" refers to ±0.5 pH unit.

The following examples are provided for illustrative purposes only and are not intended to be limiting in any way. Unless otherwise indicated, all percentages are by weight.

EXAMPLE 1

Preferred Conditioning Solution

A preferred conditioning solution of this invention was prepared by mixing the following in water (up to 1 liter): sodium formaldehyde bisulfite (15 g), thioglycerol (0.4 ml), potassium sulfite (45%, 10 ml), succinic acid buffer (4 g), diethanolamine (85%, 1 ml), potassium hydroxide (45%, 1 ml) and ethylenediaminetetraacetic acid (1 g). The final pH was 5.7.

EXAMPLES 2–3

Evaluation of Conditioner Solutions

The biocidal effectiveness of the Example 1 solution and two other conditioning solutions of this invention were evaluated. The Example 2 conditioning solution was like Example 1 except that ethylenediaminetetraacetic acid was present in an amount of 2.5 g/l. The Example 3 solution contained 1,2-cyclohexanediaminetetraacetic acid (2.5 g/l) as the biocidal agent.

The three conditioning solutions were evaluated for biocidal activity in the following manner:

Samples (200 ml each) of "seasoned" conditioning solution were collected from a conventional HOPE I 296 E-6 continuous processor. By "seasoned" is meant that conventional Process E-6 Color Developer had been carried into the conditioning solution during film processing to an extent such that the level of Color Developer was at a steady state balance between that being carried into the conditioning solution, that being carried out of the conditioning solution and that being diluted by the conditioning solution replenisher. The "seasoned" conditioning solution used in this example contained about 5–25% of Process E-6 Color Developer, but 18–22% is more typical for this particular processor.

A seasoned conditioning solution known to have considerable bacterial and fungal contamination was coarse filtered using a nylon mesh in order to remove large clumps of biogrowth. The resulting filtrate was used as a bacterial and fungal inoculum, and was added (10 ml) to each tested conditioning solution sample. With the inoculum present, each sample was determined to have an initial biological population of at least $1\times10^3$ colony forming units (CFU)/ml of solution.

After incubation at 30° C. for 3 days, each sample was evaluated for biogrowth population using a conventional Millipore Standard Plate Count Sampler and procedures. The results were reported as CFU/ml, as shown in Table I below.

In addition, Controls A, B and C were similarly evaluated. Control A was a sample (200 ml) of seasoned conditioning solution like Example 1 that contained no inoculum. Control B was a conditioning solution containing inoculum, but the ethylenediaminetetraacetic acid was omitted. Control C was a solution of inoculum only in high purity water (200 ml).

TABLE I

| Sample | CFU/ml |
|---|---|
| Control A | <10 |
| Control B | $>10^5$ |
| Control C | $>10^5$ |
| Example 1 | <10 |
| Example 2 | <10 |
| Example 3 | <10 |

EXAMPLE 4

Processing of Photographic Elements

The conditioning solution of Example 1 was used to process samples of a conventional color reversal photographic film (EKTACHROME™ Film Code 5009) using the following processing protocol in a conventional HOPE I 296 continuous processor. This film contained a conventional 1-aryl-5-pyrazolone magenta color coupler in one of the emulsion layers.

| Processing Protocol: | |
|---|---|
| 6 minutes | First Development* |
| 2 minutes | Water wash |
| 2 minutes | Reversal bath** |
| 6 minutes | Color development*** |
| 2 minutes | Conditioning |
| 6 minutes | Bleaching**** |
| 4 minutes | Fixing# |

-continued

| Processing Protocol: | |
|---|---|
| 4 minutes | Water wash |
| 2 minutes | Final wash## |
| 20 minutes | Drying |

*Development using conventional KODAK First Developer for Process E-6.
**Reversal bath was conventional KODAK Reversal Bath, Process E-6.
***Color developing using conventional KODAK Color Developer, Process E-6.
****The bleaching solution contained (per liter): a ferric complex (81.7 g) of a potassium salt of methylimidediacetic acid (12.3 g), potassium nitrate (63 g), bromide ion (23.5 g) and acetic acid (0.35 mol), and the pH was 4.5.
#The fixing solution contained (per liter): ammonium thiosulfate (55.5 g), sodium metabisulfite (11.2 g), sodium citrate, 2 hydrate (14.3 g) and citric acid (2.5 g), and had a pH of 6.5.
Final washing using KODAK Final Rinse, Process E-6.

After the film samples were processed, they were evaluated by liquid chromatography to determine residual magenta color coupler in the element, and also in an accelerated keeping test (at 77° C. and 0% relative humidity) to determine the amount of magenta dye fade. It was determined that the conditioning solution effectively stabilized the magenta color coupler in the element.

As one skilled in the art would know, the processing protocol noted above may be varied for different processing machines.

EXAMPLE 5

Processing of Various Films Using Preferred Conditioning Solution

As a further demonstration of the present invention, the Example 1 conditioning solution was used in a conventional HOPE 296 continuous processor with the processing protocol described in Example 4.

Samples of all of EKTACHROME™ Film Codes 6121, 5075, 5009, 5017 and 5045 were processed during this experiment by feeding one film after the other into the processor. The length of usefulness of the conditioning solution was measured in terms of "cycles" or "tank turnovers". One cycle is equivalent to processing 1.92 $ft^2$ (0.18 $m^2$) that requires 192 ml of conditioning solution replenishment. One tank turnover (TTO) refers to the equivalent of replacing one processing tank volume (6.2 liters in this case) with a combination of solution carried over from the previous processing step (that is, color development) and fresh conditioning solution replenisher. One TTO is equivalent to about 27 cycles. A fully "seasoned" process requires about 3 TTO (or 81 cycles).

In this example, for the first 200 cycles, aliquots of conditioning solution were periodically taken from the processing tank for evaluation of biogrowth using the procedures described in Examples 2–3. The results of using the present invention are presented in Table II below for the first 200 cycles.

Similarly, a conditioning solution from which the antimicrobial agent had been omitted was also used in processing the same types of films, and aliquots of the conditioning solution were taken and evaluated periodically. Significant biogrowth (at least $10^6$ CFU/ml) was found after less than 81 cycles (3 TTO's).

TABLE II

| Aliquot | Percent Seasoned* | pH | Cycles | Approximate TTO | CFU/ml |
|---|---|---|---|---|---|
| 1 | 0 | 5.30 | 0 | 0 | <10 |
| 2 | 20 | 5.45 | 6 | 0 | <10 |
| 3 | 72 | 6.50 | 38 | 1.5 | <10 |
| 4 | 95 | 6.90 | 95 | 3.5 | <10 |
| 5 | 99 | 6.90 | 130 | 5 | <10 |
| 6 | 100 | 6.91 | 200 | 7 | <10 |

*Level of seasoning in conditioning solution from carryover of color developer from previous processing step.

It is clear that the conditioning solution of the present invention was free of biogrowth after considerable processing time due to the presence of the antimicrobial agent, ethylenediaminetetraacetic acid at 1 g/l. The various films used in the experiment are not critical to demonstration of the benefits of the invention. The films are merely used to carry solutions through the processor in order to replicate actual customer processing conditions. The lack of biogrowth would be apparent no matter what films or their order of processing.

EXAMPLE 6

Long-Term Evaluation for Biogrowth

The present invention (Example 1 conditioning solution) was also evaluated long-term using a conventional Hostert Type DPP 40/120 rack and tank processor. The conventional EKTACHROME™ films described in Example 5 were processed as well as several conventional films manufactured by Fuji Photo Co. and Agfa Corporation (the types or order of films is not critical to this invention). The processing protocol was as follows:

| Processinq Protocol: | |
|---|---|
| 6 minutes | First Development* |
| 3 minutes | Water wash |
| 3 minutes | Reversal bath** |
| 6 minutes | Color development*** |
| 3 minutes | Conditioning |
| 6 minutes | Bleaching**** |
| 6 minutes | Fixing# |
| 6 minutes | Water wash |
| 3 minutes | Final wash## |
| 30 minutes | Drying |

*Development using conventional KODAK First Developer for Process E-6.
**Reversal bath was conventional KODAK Reversal Bath, Process E-6.
***Color developing using conventional KODAK Color Developer, Process E-6.
****The bleaching solution was the same as in Example 4.
#The fixing solution was the same as in Example 4.
Final washing using KODAK Final Rinse, Process After 6.4 TTO (45 liter tank) over a five month period of processing, the conditioning solution bath was evaluated for biogrowth as described in Examples 2–3. No biogrowth (<10 CFU/ml) was detected.

The invention has been described in detail with particular reference to preferred embodiments thereof, but it will be understood that variations and modifications can be effected within the spirit and scope of the invention.

We claim:

1. A conditioning solution having a pH of from about 4.5 to about 8, and comprising a bleach accelerating agent, a formaldehyde precursor, and an antimicrobial composition consisting essentially of a polyaminocarboxylic acid or salt thereof as the sole antimicrobial agent, said antimicrobial agent being present in said conditioning solution in an amount of from about 0.25 to about 3 g/l, said polyaminocarboxylic acid or salt thereof being represented by formula II:

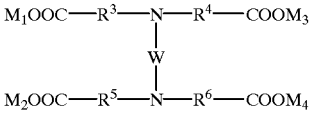

wherein $R^3$, $R^4$, $R^5$ and $R^6$ are independently an alkylene group of 1 to 8 carbon atoms, W is a covalent bond or methylene, ethylene or a cycloalkylene having 5 to 7 carbon atoms in the ring, provided that when W is cycloalkylene, the two nitrogen atoms are attached to the ring at adjacent carbon atoms, and $M_1$, $M_2$, $M_3$ and $M_4$ are independently hydrogen or a monovalent cation.

2. The solution of claim 1 having a pH of from about 4.5 to about 6.5.

3. The solution of claim 1 wherein said bleach accelerating agent is an aliphatic thiol.

4. The solution of claim 1 wherein said formaldehyde precursor is an N-methylol compound, sodium formaldehyde bisulfite or hexamethylenetetramine.

5. The solution of claim 4 wherein said formaldehyde precursor is sodium formaldehyde bisulfite.

6. A conditioning solution having a pH of from about 4.5 to about 8, and comprising a bleach accelerating agent, a formaldehyde precursor, and an antimicrobial composition consisting essentially of a polyaminocarboxylic acid or salt thereof as the sole antimicrobial agent, said antimicrobial agent being present in said conditioning solution in an amount of less than about 3 g/l, wherein said sole antimicrobial agent is either ethylenediaminetetraacetic acid or 1,2-cyclohexanediaminetetraacetic acid.

7. The solution of claim 1 wherein $R^3$, $R^4$, $R^5$ and $R^6$ are independently an alkylene group of 1 to 3 carbon atoms.

8. The solution of claim 7 wherein $R^3$, $R^4$, $R^5$ and $R^6$ are independently methylene or ethylene, and W is methylene, ethylene or cyclohexylene.

9. The solution of claim 1 further comprising a secondary amine.

10. The solution of claim 9 wherein said antimicrobial agent is either ethylenediaminetetraacetic acid or 1,2-cyclohexanediaminetetraacetic acid.

11. The solution of claim 1 wherein said antimicrobial agent is present in said conditioning solution in an amount of from about 0.25 to about 2.5 g/l.

12. A method for processing a color silver halide photographic element comprising:

A) treating an imagewise exposed and developed color silver halide photographic element with a conditioning solution having a pH of from about 4.5 to about 8, and comprising a bleach accelerating agent, a formaldehyde precursor, and an antimicrobial composition consisting essentially of a polyaminocarboxylic acid or salt thereof as the sole antimicrobial agent, said antimicrobial agent being present in said conditioning solution in an amount of less than about 3 g/l, said polyaminocarboxylic acid or salt thereof being represented by formula II:

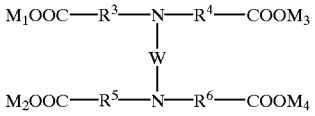

wherein $R^3$, $R^4$, $R^5$ and $R^6$ are independently an alkylene group of 1 to 8 carbon atoms, W is a covalent bond or methylene, ethylene or a cycloalkylene having 5 to 7 carbon atoms in the ring, provided that when W is cycloalkylene, the two nitrogen atoms are attached to the ring at adjacent carbon atoms, and $M_1$, $M_2$, $M_3$ and $M_4$ are independently hydrogen or a monovalent cation, and B) bleaching said element treated in step A.

13. The method of claim 12 for the processing of a color reversal film comprising treatment with a first development bath, a reversal bath and a color developer prior to step A, and treatment with a fixing bath and final wash after said bleaching step B.

14. The method of claim 12 wherein said color silver halide photographic element contains an arylpyrazolone magenta dye forming color coupler.

15. The method of claim 12 wherein said conditioning solution has a pH of from about 4.5 to about 6.5 and said bleach accelerating agent is an aliphatic thiol.

16. The conditioning solution of claim 6 wherein said sole antimicrobial agent is present in an amount of from about 0.5 to about 1.5 g/l.

17. The method of claim 12 wherein $R^3$, $R^4$, $R^5$ and $R^6$ are independently an alkylene group of 1 to 3 carbon atoms.

18. The method of claim 17 wherein said antimicrobial agent is either ethylenediaminetetraacetic acid or 1,2-cyclohexanediaminetetraacetic acid.

19. The method of claim 12 wherein said antimicrobial agent is present in said conditioning solution in an amount of from about 0.25 to about 3 g/l.

20. The method of claim 19 wherein said antimicrobial agent is present in said conditioning solution in an amount of from about 0.5 to about 1.5 g/l.

* * * * *